US005901669A

United States Patent [19]

Phelps, Sr.

[11] Patent Number: 5,901,669

[45] Date of Patent: May 11, 1999

[54] VARIABLE PRESSURE ONCE-THROUGH STEAM GENERATOR UPPER FURNACE HAVING NON-SPLIT FLOW CIRCUITRY

[75] Inventor: Calvin E. Phelps, Sr., Akron, Ohio

[73] Assignee: The Babcock & Wilcox Company, New Orleans, La.

[21] Appl. No.: 08/417,167

[22] Filed: Apr. 5, 1995

[51] Int. Cl.[6] ..... F22B 37/00

[52] U.S. Cl. ..... 122/6 A; 122/235.11; 122/235.12; 122/235.14; 122/235.15; 122/235.24; 122/511

[58] Field of Search ..... 122/235.11, 235.12, 122/235.14, 235.15, 235.22, 235.24, 235.25, 6 A, 511

[56] References Cited

U.S. PATENT DOCUMENTS 4,465,023 8/1984 Wagner ..... 122/6 A
4,704,992 11/1987 Waryasz ..... 122/4 D
4,987,862 1/1991 Wittchow et al. ..... 122/6 A
5,201,282 4/1993 Albrecht ..... 122/235.23
5,347,955 9/1994 Wittchow ..... 122/6 A
5,560,322 10/1996 Fitzgerald ..... 122/6 A

*Primary Examiner*—Teresa J. Walberg
*Assistant Examiner*—Jiping Lu
*Attorney, Agent, or Firm*—Daniel S. Kalka; Robert J. Edwards

[57] ABSTRACT

A once-through steam generator having single pass non-split fluid flow upper furnace circuitry with a one to one connection of tubes of the lower furnace spiral or vertical tube assembly being connected to the vertical tubes of the upper furnace assembly to prevent steam water separation and provide a fully drainable flow circuit.

7 Claims, 2 Drawing Sheets

VARIABLE PRESSURE ONCE-THROUGH STEAM GENERATOR UPPER FURNACE HAVING NON-SPLIT FLOW CIRCUITRY

BACKGROUND OF THE INVENTION

1. Field of the Invention

The present invention relates to steam generators in general and in particular to such steam generators of the Once-Through or "Benson" type also known as the Universal-Pressure boilers which have spiral and vertical flow furnace circuitry.

2. Description of the Related Art

The Universal Pressure boiler or the Once-Through boiler, derives its name from the fact that it was developed to be applicable functionally at all commercial temperatures and pressures, subcritical and supercritical. Numerically the boiler parameters and operating conditions are as follows:

Range in capacity, steam output about 300,000 lb/hr to an undetermined maximum exceeding 10,000,000 lb/hr.

Operating pressure subcritical, usually at 2400 psi constant throttle pressure, and supercritical usually at 3500 psi constant throttle pressure. Variable operating pressure from the boiler feedwater pumps to the turbine throttle valves, over the operating load range is closely identified with the "Benson" boiler and its spiral furnace.

Steam and reheat temperatures as required, usually 1000 F. Constant steam temperature can be maintained to minimum once-through load with any fuel. Constant reheat temperature can be maintained to an intermediate load with any fuel, including coal, oil, or natural gas.

Operational control is completely automatic, including pumping and firing-rate control and steam temperature control.

The principle of operation is that of the once-through or "Benson" cycle. The working fluid is pumped into the unit as liquid, passes sequentially through all the pressure-part heating surfaces, where it is converted to steam as it absorbs heat, and leaves as steam at the desired temperature. There is no recirculation of water within the unit and, for this reason, a drum is not required to separate water from steam above the minimum once-through load or "Benson Point".

The furnace is completely fluid cooled. The flue gas side may be designed for balanced draft or pressure operation. Ash removal may be either dry or wet. Reheaters for single or two-stage reheat may be incorporated in the design for the reheat cycle.

Gas tempering, if used on pulverized coal fired units, controls gas temperatures entering the superheater and minimizes slagging in these surfaces. Reheater steam temperature is controlled by gas-recirculation, excess air, flue gas split flow control, and attemperation, separately or in combination.

The once-through boiler is designed to require a minimum flow inside the furnace circuits to prevent overheating of furnace tubes during all operating conditions. This flow must be established before start-up of the boiler. A bypass system, integral with the boiler, turbine, condensate and feedwater system, is provided so that the minimum design flow can be maintained through pressure parts which are exposed to high temperature combustion gases during the start-up operations and at other times when the required minimum flow exceeds the turbine steam demand. The minimum flow for startup may be established by a furnace recirculating pump or the boiler feedwater pump.

The bypass system includes steam-water separation equipment, such as a flash tank or vertical separator(s) and performs the following additional functions:

1. Controls the pressure and temperature of the steam leaving the boiler during start-up to conditions suitable for the turbine, condenser and auxiliary equipment.
2. Provides means for recovering heat flowing to the bypass system, during start-up and low-load operations, utilizing the feedwater heaters or a furnace recirculating pump.
3. Provides means for conditioning the water during start-up without delaying boiler and turbine warming operations.
4. Protects the high temperature (secondary) superheater against shock from water during start-up.
5. Provides means for relieving excessive pressure in the system after a load trip.

Prior art variable operating pressure once through boilers or steam generators use furnace tube circuitry wherein the heated fluid flows from either vertical or spiral furnace tubing located around the total perimeter of the lower part of the generator to vertical tubing located in the upper part of the generator. With lower furnace spiral tubing construction, headers, bifurcates, trifurcates, bottles, or other fittings were located in the transition zone of the boiler and were used to split the fluid from the spiral tubes into a greater number of vertical tubes. Thus fluid flow leaving a spiral tube was usually split into two or more paths. Spiral tube connections at their upper termination in the furnace rear wall used a more extensive combination of headers and other fittings to split each spiral tube flow into multiple paths to form the construction for the furnace arch, front screen, pendent convection pass sidewalls, floor, and sometimes, the rear screen tube components. Furnaces recently equipped with all vertical tubing that operate variable pressure are commercially available, but their reliability and availability are currently being experienced. Furnaces with all vertical tubing can be designed with non-split flow circuitry for the upper front and sidewalls, but the rear wall flow is split to supply the various paths in the downstream upper furnace, e.g., the arch, screens, and pendant convection pass walls and floor.

It is necessary, when splitting a subcritical pressure steam-water mixture flow path as in the upper furnace tubing, that the downstream component receiving the split flow be designed for steam-water separation. This requires added fluid flow pressure loss to be built in to ensure for static stability. Tubes that receive all water, or a mixture with significantly less than average inlet steam quality, may not circulate sufficiently. The flow may stagnate, reverse, oscillate, or natural recirculation may occur within the component. All of these cause furnace materials to overheat if the pressure loss is not designed into the component to ensure sufficient forward circulation. The additional pressure loss required for static stability for the prior art designs caused higher plant heat rates due to the additional energy consumed by the boiler feedwater pump-drive. The additional pressure loss caused all upstream components, including the lower furnace, economizer, and feedwater system to the boiler feedwater pump to be designed for a higher pressure, and thus thicker walled pressure parts and additional costs. These split flow circuitry designs caused steam-water separation and resulted in some tubes receiving all steam, or a high quality steam mixture. The result caused the upper furnace, including the furnace outlet headers and the mechanical supports to be designed for an elevated temperature since the tubes receiving all steam absorbed enough heat to be significantly superheated over saturated steam thermodynamic conditions. The tube material has less strength at higher temperatures and hence they had to be thicker, more structurally supported, and upgraded to a higher strength alloy material. The upper furnace enclosure tubes and membranes, and screen tubes also had to be upgraded to a higher oxidation resistant alloy material due to the higher design temperatures.

The prior art designs were also non-drainable in some areas of the upper furnace rear wall circuitry, especially designs that attempted to minimize the number of intermediate headers or other fittings connecting the lower furnace tubes to the upper furnace tubes. Some portions of the upper furnace tube circuitry were constructed with pockets that did not drain water completely for maintenance purposes and became susceptible to out of service corrosion.

Thus it is seen that a fully drainable flow circuit was required which would reduce fluid flow pressure losses, and eliminate the heat transfer and material temperature levels and differentials caused by the split flow paths in the upper furnace rear wall circuitry of once-through boilers.

SUMMARY OF THE INVENTION

The present invention is directed to solving the problems associated with prior art flow circuits as well as others by providing a single pass, non-split fluid flow upper furnace circuit for a once-through steam generator that continuously connects the lower furnace spiral or vertical tubes to the upper furnace vertical tubes for variable furnace pressure operation. To accomplish this aim, the upper and lower furnace sections are designed with the same number of tubes so that the fluid flow paths can be connected on a one to one basis through a transition zone of the generator without splitting the flow from any lower furnace tube as it passes to the upper furnace vertical tubes. Thus no headers, bottles, bifurcates, trifurcates, or other fittings are required.

The circuitry forming the membraned tube enclosure for the furnace walls, arch, pendent convection pass floor, and pendent convection pass front sidewall panels of the generator are made of all welded, flue gas tight construction, including the front screen tube penetrations, since all adjoining parts now operate at nearly the same temperature.

In view of the foregoing it will be seen that one aspect of the present invention is to provide a less costly and more reliable flow circuitry for a once-through steam generator that operates with variable pressure.

Other aspects of the present invention is to provide flow circuitry for a once-through steam generator which will have reduced temperature levels and differentials, reduced fluid flow pressure loss, and improved stability.

Another aspect of the present invention is that the furnace rear wall and arch junction is formed in manufacturing by pack bending since they will be continuous circuits. Complex construction caused by joining multiple circuits is eliminated; thereby, improving construction and unit reliability.

Yet another aspect of the present invention is to provide a totally drainable flow circuitry for a once-through steam generator to prevent down time corrosion of the generator.

These and other aspects of the present invention will be more fully understood upon a review of the following description of the preferred embodiment when considered with the accompanying drawing.

DESCRIPTION OF THE PREFERRED EMBODIMENT

The present description is intended to disclose the preferred embodiment of the present invention but is not intended to limit it thereto.

The present invention relates to a once-through steam generator assembly 10 which is known as a Universal-Pressure (UP) boiler. The Universal Pressure boiler is a high-capacity, high-temperature boiler of the "Benson" type that is functionally applicable at any boiler pressure. Firing may be by coal, either pulverized or Cyclone-Furnace-fired or by natural gas or oil, or other suitable combustible material.

The working fluid, for example water, is pumped into the unit as liquid, and passes sequentially through all the pressure-part heating surfaces, where it is converted to steam as it absorbs heat, and leaves as steam at the desired temperature. There is no recirculation of water within the unit and, for this reason, a drum is not required to separate water from steam. The once-through boiler may be designed to operate at either subcritical, supercritical, or variable pressures.

The assembly 10 may be a unit complete in itself without auxiliary heat absorbing equipment, or it may constitute a rather small part of a large steam generating complex in which the steam is generated primarily in the furnace tubes, and the convection surface consists of a superheater, reheater, economizer and air heater. In the latter case, a drum-type boiler comprises only the steam drum and the screen tubes between the furnace and the superheater. However, the furnace water-wall tubes, and usually a number of sidewall and support tubes in the convection portion of the unit, discharge steam into the drum and therefore effectively form a part of the boiler.

Figure 1:
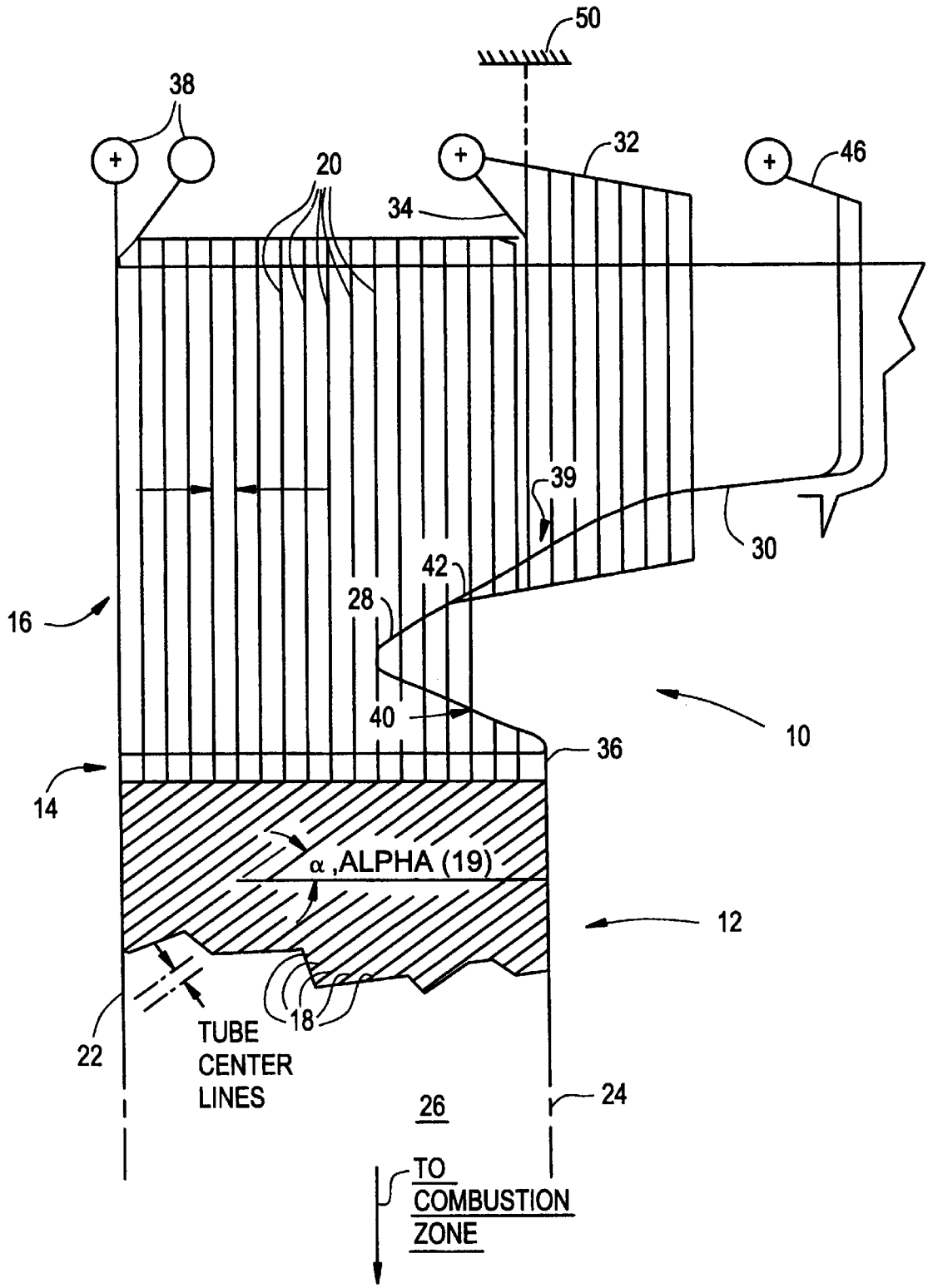
FIG. 1 illustrates the upper furnace rear wall circuitry of once-through steam generator.
Figure 2:
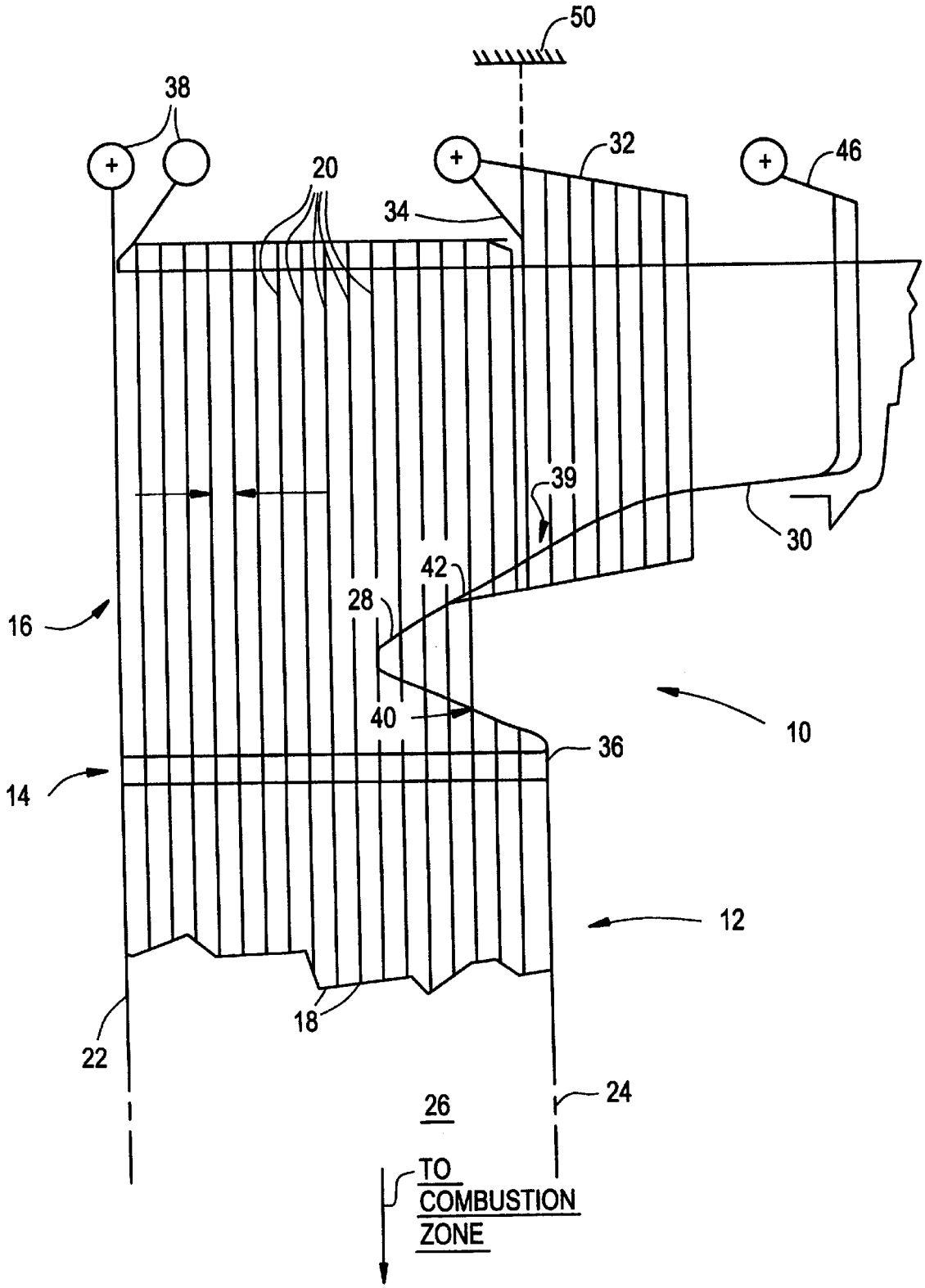
FIG. 2 illustrates an alternate embodiment of the upper furnace rear wall circuitry of a once-through steam generator.

In the case of the once-through boiler, there is no steam drum, but rather an arrangement of tubes in which steam is generated and superheated. As seen in FIG. 1, the lower zone 12 of a Spiral Wound Universal Pressure (SWUP) boiler has a series of spiral tubes extending around the circumference which are connected on a one-to one basis through a transition zone 14 to a series of vertical tubes in the upper zone 16. It is necessary in all boiler designs to give proper consideration to the performance required from the total complex.

With reference to FIG. 1, it will be seen that in the single pass, non-split fluid upper furnace circuitry of the present invention the lower furnace spiral tubes (18) connect continuously to the upper furnace vertical tubes (20) in a once-through steam generator designed for variable furnace pressure operation. The lower furnace may be designed with vertical tubing. The upper and lower furnace (12, 16) is designed with the same number of tubes, by using technological design information. The fluid flow paths are connected on a one to one basis through the transition zone (14) without splitting flow from any spiral or vertical tube as it passes to the upper furnace (16). Intermediate headers, bottles, bifurcates, trifurcates, or other fittings are thus not required.

Since all adjoining parts operate at nearly the same temperature because there is no splitting of flow which resulted in different heat transfer rates in the split tubing of the prior art devices, the circuitry forming the membraned tube enclosure for the furnace front, rear, and side walls (22, 24, 26), arch (28), pendent convection pass floor (30), and pendent convection pass front sidewall panels (32) are made of all welded, flue gas tight construction, including the front screen tube (34) penetrations through the enclosures.

The present flow circuitry is not susceptible to corrosion from water remaining in the flow circuit during any drainage of the circuitry during a shut down of the generator. To understand this feature reference is made to the heavy line circuitry from the spiral furnace termination (36) on the rear wall (24) to the arch (28). Multiple downstream components in the upper furnace area are all supplied in parallel without splitting the fluid flow from any spiral furnace tube and without forming any horizontal non-drainable water pocket. Similar upper furnace construction may be used on a unit with lower furnace vertical tubing. The upper furnace (16) front and sidewalls are constructed vertically upwards to complete these walls without the complications of supplying other downstream components before flowing to their respective outlet headers (38).

The design heat absorption rate is approximately one-third on the top side (39) of the arch (28) as the underside (40) of the arch (28) which is fully exposed to furnace radiation. This allows the tube centerlines to be increased significantly on top of the arch (28). This permits sufficient tubes to be routed outside the setting at location (42) to construct the front screen tube (34) and the pendent convection pass front sidewall (32) membraned panels. The arch tube circuit downstream of location (42) is constructed by bending tubes and installing closure plates to seal weld openings left by the rerouted tubes and designing the remaining arch circuit and pendent convection pass floor (30) to increase membraned tube centerlines. Rear screen tubes (46) are constructed as a continuation of the pendent convection pass floor (30). The furnace rear wall (24) dead loads are supported through mechanical or spring linkages to the front screen tubes (34) and to boiler top supports (50).

Thus it is seen that the present invention will provide the following benefits:

(a) substantially reduce capital costs for the upper furnace rear walls, including the arch, front screen tubes, pendent convection pass floor and sidewalls, rear screen tubes, and all the furnace and screen outlet headers by reducing their design temperature requirements, and by reducing their complexity of design; thereby, reducing capital costs for materials, production, and construction, (b) reduce material temperature differentials in adjoining areas of the circuitry to improve thermal stresses; thereby reducing pressure part failures and forced outage rates, (c) improve furnace dynamic stability and reduce thermal shock cycles; thereby, reducing pressure part failures and forced outage rates, (d) provide all drainable circuitry; reduce susceptibility to out of service corrosion; thereby, reducing pressure part failure and higher forced outage rates, (e) substantially improve plate heat rates by reducing furnace fluid flow pressure loss and feedwater pump-drive energy consumption; thereby, decreasing fuel usage and exhaust of combustion products and pollutants into the atmosphere, and (f) improve the arch-furnace rear wall construction at their junction since circuit splits are eliminated here; thereby reducing mechanical failure rates and outage time.

Certain modification and improvements will occur to those skilled in the art upon reading this description. It will be understood that such modifications and improvements have been deleted herein for the sake of conciseness and readability but are included in the scope of the following claims.

What is claimed is:

1. In a once-through steam generator having a fluid flow circuitry that includes furnace front, rear, and side walls, the improvement comprising:

a series of spiral tubes extending around a lower furnace area of the steam generator;

a series of vertical tubes located in an upper furnace area of the steam generator, said upper and lower furnace areas of the steam generator having a same number of tubes; and said series of upper furnace vertical tubes being connected continuously on a one to one basis to said series of lower furnace spiral tubes in a transition zone in an all welded, flue gas tight construction to prevent any fluid flow splits.

2. A generator as set forth in claim 1, wherein said series of upper furnace vertical tubes is formed from a rear wall transition.

3. A generator as set forth in claim 1 further comprising a series of upper furnace vertical pendant tubes situated in a convection pass of the steam generator connected on a one to one basis to said spiral tubes to provide a single pass fluid flow.

4. A generator as set forth in claim 3 further comprising a series of upper furnace screen tubes situated in the convection pass of the steam generator connected on a one to one basis to said spiral tubes to provide a single pass fluid flow.

5. A generator as set forth in claim 4, wherein said screen tubes and said vertical pendant tubes are connected continuously on a one to one basis to lower furnace tubing to provide a single pass fluid flow.

6. Fluid flow circuitry for a once-through steam generator comprising:

a series of vertical tubes located in an upper furnace area of the generator;

a series of spiral tubes located in a lower furnace area of the generator, said upper and lower furnace areas of the steam generator having a same number of tubes; and means for connecting said series of vertical tubes to said series of spiral tubes on a one to one basis to prevent any fluid flow splits, said connecting means including an all welded, flue gas tight construction.

7. A flow circuit as set forth in claim 6 wherein said connecting means further includes drainable surfaces in any connection of said tubing to prevent any water retention during a drainage of the flow circuitry.

* * * * *